US010153546B2

(12) United States Patent
Kolak et al.

(10) Patent No.: US 10,153,546 B2
(45) Date of Patent: Dec. 11, 2018

(54) COMPOSITE ANTIBALLISTIC RADOME WALLS AND METHODS OF MAKING THE SAME

(71) Applicant: DSM IP ASSETS B.V., Heerlen (NL)

(72) Inventors: Lewis Kolak, Echt (NL); Mark Mirotznik, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 27 days.

(21) Appl. No.: 14/902,515

(22) PCT Filed: Jul. 1, 2014

(86) PCT No.: PCT/EP2014/064001
§ 371 (c)(1),
(2) Date: Dec. 31, 2015

(87) PCT Pub. No.: WO2015/000926
PCT Pub. Date: Jan. 8, 2015

(65) Prior Publication Data

US 2016/0380345 A1 Dec. 29, 2016

Related U.S. Application Data

(60) Provisional application No. 61/842,271, filed on Jul. 2, 2013.

(51) Int. Cl.
*H01Q 1/42* (2006.01)
*F41H 5/04* (2006.01)
*F42B 10/46* (2006.01)

(52) U.S. Cl.
CPC ..... *H01Q 1/422* (2013.01); *F41H 5/0478* (2013.01); *F42B 10/46* (2013.01)

(58) Field of Classification Search
CPC ..... H01Q 1/42
(Continued)

(56) References Cited

U.S. PATENT DOCUMENTS 2,659,884 A 11/1953 McMillan et al.
3,553,244 A 1/1971 Grigat et al.
(Continued)

FOREIGN PATENT DOCUMENTS

EP 0 205 960 12/1986
EP 0 269 151 6/1988
(Continued)

OTHER PUBLICATIONS

International Search Report for PCT/EP2014/064001, dated Oct. 31, 2014, 5 pages.
(Continued)

*Primary Examiner* — Dameon E Levi
*Assistant Examiner* — Hasan Islam
(74) *Attorney, Agent, or Firm* — Nixon & Vanderhye P.C.

(57) ABSTRACT

Composite radome wall structures (10) exhibit both antiballistic and radar transparency properties and include an antiballistic internal solid, void-free core (12) and external antireflective (AR) surface layers (14-1, 14-2) which sandwich the core. The antiballistic core can be a compressed stack of angularly biased unidirectional polyethylene monolayers formed of tapes and/or fibers. Face sheets (16-1, 16-2) and/or one or more impedance matching layers (27, 28) may optionally be positioned between the antiballistic core and one (or both) of the external AR layers so as to bond the core to the AR surface layer(s) and/or selectively tune the radome wall structure to the frequency of transmission and reception associated with the radar system.

33 Claims, 8 Drawing Sheets

(58) Field of Classification Search
USPC ..... 343/872, 873
See application file for complete search history.

(56) References Cited

U.S. PATENT DOCUMENTS

| | | | | |
|---|---|---|---|---|
| 4,097,455 | A | 6/1978 | Burkhardt et al. | |
| 4,110,364 | A | 8/1978 | Gaku et al. | |
| 4,157,360 | A | 6/1979 | Prevorsek et al. | |
| 4,330,658 | A | 5/1982 | Ikeguchi et al. | |
| 4,330,669 | A | 5/1982 | Ikeguchi et al. | |
| 4,371,689 | A | 2/1983 | Gaku et al. | |
| 4,496,695 | A | 1/1985 | Sugio et al. | |
| 4,528,366 | A | 7/1985 | Woo et al. | |
| 4,665,154 | A | 5/1987 | Varnell et al. | |
| 4,725,457 | A | 2/1988 | Ward et al. | |
| 4,782,116 | A | 11/1988 | Holte | |
| 4,782,178 | A | 11/1988 | Godschalx et al. | |
| 4,785,075 | A | 11/1988 | Shimp | |
| 4,902,752 | A | 2/1990 | Shimp | |
| 4,980,696 | A | 12/1990 | Stone et al. | |
| 4,983,683 | A | 1/1991 | Shimp | |
| 5,244,720 | A * | 9/1993 | Leung | C03C 14/002 156/155 |
| 5,323,170 | A | 6/1994 | Lang | |
| 5,662,293 | A | 9/1997 | Hower et al. | |
| 5,766,725 | A | 6/1998 | Hogenboom et al. | |
| 6,028,565 | A * | 2/2000 | Mackenzie | H01Q 1/422 343/872 |
| 6,107,976 | A | 8/2000 | Purinton | |
| 6,450,208 | B1 | 9/2002 | Khokar | |
| 7,420,523 | B1 * | 9/2008 | Ziolkowski | H01Q 1/422 343/872 |
| 7,527,854 | B2 | 5/2009 | Jacobs et al. | |
| 7,993,715 | B2 | 8/2011 | Geva et al. | |
| 8,128,778 | B2 | 3/2012 | Geva et al. | |
| 9,744,741 | B2 | 8/2017 | Cordova et al. | |
| 2002/0135869 | A1 | 9/2002 | Banish et al. | |
| 2004/0113305 | A1 | 6/2004 | Geyer | |
| 2006/0145940 | A1 * | 7/2006 | Kuroda | H01Q 1/42 343/911 R |
| 2008/0136731 | A1 * | 6/2008 | Wu | F41H 5/0428 343/872 |
| 2009/0148681 | A1 | 6/2009 | Utsumi et al. | |
| 2009/0167628 | A1 | 7/2009 | Frenkel | |
| 2010/0064404 | A1 | 3/2010 | Van Es et al. | |
| 2011/0203450 | A1 | 8/2011 | Carbajal et al. | |
| 2012/0176294 | A1 * | 7/2012 | Kviatkofsky | F42B 10/46 343/872 |
| 2013/0214988 | A1 * | 8/2013 | Brady | H01Q 1/422 343/872 |
| 2013/0321236 | A1 * | 12/2013 | Ziolkowski | H01Q 1/424 343/872 |
| 2015/0222011 | A1 | 8/2015 | Kolak et al. | |

FOREIGN PATENT DOCUMENTS

| | | |
|---|---|---|
| EP | 0 359 504 | 3/1990 |
| EP | 0 420 137 | 4/1991 |
| EP | 0 470 271 | 2/1992 |
| EP | 0 504 954 | 9/1992 |
| EP | 0 733 460 | 9/1996 |
| GB | 633943 | 12/1949 |
| GB | 821250 | 10/1959 |
| GB | 851923 | 10/1960 |
| GB | 2 042 414 | 9/1980 |
| GB | 2 051 667 | 1/1981 |
| JP | 5-339342 | 12/1993 |
| JP | 6-120689 | 4/1994 |
| JP | 8-253582 | 10/1996 |
| JP | 11-300872 | 11/1999 |
| JP | 2002-193047 | 7/2002 |
| JP | 2008-507885 | 3/2008 |
| JP | 2009-141736 | 6/2009 |
| JP | 2009-198627 | 9/2009 |
| JP | 2011-522201 | 7/2011 |
| WO | WO 88/01440 | 2/1988 |
| WO | WO 01/73173 | 10/2001 |
| WO | WO 2006/075961 | 7/2006 |
| WO | WO 2008/082421 | 7/2008 |
| WO | WO 2012/080317 | 6/2012 |
| WO | WO 2014/057051 | 4/2014 |

OTHER PUBLICATIONS

Written Opinion of the ISA for PCT/EP2014/064001, dated Oct. 31, 2014, 7 pages.

Mirotznik et al., "Broadband Antireflective Properties of Inverse Motheye Surfaces", IEEE, vol. 58, No. 9, Sep. 1, 2010, pp. 2969-2980.

* cited by examiner

COMPOSITE ANTIBALLISTIC RADOME WALLS AND METHODS OF MAKING THE SAME

This application is the U.S. national phase of International Application No. PCT/EP2014/064001 filed 1 Jul. 2014, which designated the U.S. and claims the benefit of U.S. Provisional Application No. 61/842,271 filed 2 Jul. 2013, the entire contents of each of which are hereby incorporated by reference.

The disclosed embodiments herein relate to radomes that may be employed usefully in a radar system comprised of a radar antenna. The embodiments of the radomes disclosed herein have both antiballistic and electromagnetic transmission properties and thus find particular utility for use in radar systems which may be exposed to ballistic threats, e.g., radar systems on board various combat vehicles, vessels and aircraft.

A radome is an electromagnetic cover for a radar system, i.e., a system comprising a radar antenna, and it is used to protect the system from environmental elements and threats, such as shielding it for example against wind, rain, hail and the like. An important requirement of a radome is that the radome does not substantially adversely affect a radar wave which passes through the radome; but also when a reflected radar wave enters back through the radome to be received by the radar antenna. Therefore, the radome should in principle have two primary qualities, namely sufficient structural integrity and durability for the environmental elements and adequate electromagnetic transparency (i.e., adequate electromagnetic performance providing a satisfactory transmission efficiency of radar waves thorough the radome).

The electromagnetic performance of a radome is typically measured by a radome's ability to minimize reflection, distortion and attenuation of radar waves passing through the radome in a direction. The transmission efficiency is analogous to the radome's apparent transparency to the radar waves and is expressed as a percent of the radar's transmitted power measured when not using a radome cover on the system. As radomes can be considered as electromagnetic devices, transmission efficiency can be optimized by tuning the radome. The tuning of a radome is managed according to several factors, including thickness of the radome wall and the composition thereof. For example by carefully choosing materials having a determined dielectric constant and loss tangent, each of which being a function of the wave frequencies transmitted or received by the radar system, the radome can be tuned. A radome which is poorly tuned will attenuate, scatter, and reflect the radar waves in various directions, having deleterious effect on the quality of the radar signal.

Prior known radome wall structures which have been found to perform well are referred to as an A-sandwich construction. An A-sandwich radome wall contains a composite panel containing an expanded core, e.g., a honeycomb or a foam containing core, bounded by facings usually containing an epoxy/fiberglass laminate. The thickness of the entire sandwich construction, core and facings, is approximately a quarter wavelength thick for near incidence angles of radar waves. Such A-sandwich radome walls are disclosed for example by EP 0 359 504; EP 0 470 271; GB 633,943; GB 821,250; GB 851,923; U.S. Pat. Nos. 2,659,884; 4,980,696; 5,323,170; 5,662,293; 6,028,565; 6,107,976; and US 2004/0113305, the entire content of each of these cited publications, and any other publication cited herein, is expressly incorporated hereinto by reference.

While these prior known A-sandwich constructions exhibit suitable electromagnetic transparency and for provide sufficient structural integrity to shield the radar system from general environmental threats, they do not provide anti-ballistic protection. It of course is self-evident that various combat vehicles which employ a radar system (e.g., infantry vehicles, manned and unmanned aircraft, and naval vessels) are potentially subjected to ballistic threats from opposing forces. It would therefore be very beneficial if radome wall structures could be provided not only with adequate electromagnetic transparency properties, but also with adequate anti-ballistic properties. It is towards providing such improvements that the embodiments disclosed herein are directed.

In general, the composite radome wall structures as disclosed herein comprise an antiballistic internal solid, void-free core and external antireflective (AR) surface layers which sandwich the core. According to certain embodiments, the antiballistic core comprises a compressed stack of angularly biased unidirectional polyolefin (e.g., polyethylene or polypropylene, especially ultrahigh molecular weight polyethylene (UHMWPE)) monolayers as will be described in greater detail below. Face sheets and/or one or more impedance matching layers may optionally be positioned between the antiballistic core and one (or both) of the external AR layers so as to bond the core to the AR surface layer(s) and/or selectively tune the radome wall structure to the frequency of transmission and reception associated with the radar system.

An example of an impedance matching surface that may be used in the composite radome wall structures as disclosed herein is a foam, that is for instance an expanded polymeric material, in order to achieve ultra wideband performance while maintaining good structural and ballistic properties. Suitable polymeric materials for manufacturing such foams are thermoplastic and thermosetting materials, examples thereof including polyisocyanates, polystyrene, polyolefins, polyamides, polyurethanes, polycarbonates, polyacrylates, polyvinyls, polyimides, polymethacrylimides and blends thereof but also other synthetic materials such as rubbers and resins. Suitable examples of preferred polymeric materials include polyethylene terephthalate (PET), polyetherimide (PEI), meta-aramids, epoxy resins, cyanate ester, PTFE, and polybutadiene. A particular example of a foam is a syntactic foam, i.e. a foam containing glass microballoons. Such foams are known in the art, specific examples thereof being given in the above-mentioned publications. Preferably, the polymeric foam is a closed-cell foam, i.e. a foam wherein most cells, preferably all cells, are entirely surrounded by a cell wall. Preferably said foam has cells having a diameter in the range between 1 μm and 80 μm, more preferably between 5 μm and 50 μm, most preferably between 10 μm and 30 μm Preferably said foam has a density of between 20 and 220 kg/m$^3$, more preferably of between of between 50 and 180 kg/m$^3$, most preferably of between of between 110 and 140 kg/m$^3$. Preferably, the foam has a dielectric constant of at most 1.40, more preferably of at most 1.15, most preferably of at most 1.05. Preferably the foam has a compressive modulus as measured in accordance with ASTM D1621 of 13.000 psi, more preferably of 15.000 psi, most preferably of 25.000 psi. In another embodiment, the expanded polymeric material can be an open-cell foam or a honeycomb. A common characteristic thereof is that both these types of expanded materials have cells not completely surrounded by a cell wall.

The composite radome wall structures will typically exhibit an electromagnetic transmission efficiency at a frequency of 2 to 40 GHz of 90% or greater. According to certain embodiments, therefore, a transmission loss of 0.5 dB and less will occur over a frequency range of 2 to 40 GHz.

In addition to radar transparency as noted above, the radome wall structures according to embodiments disclosed herein will exhibit antiballistic properties, specifically National Institute of Justice (NIJ) Standard Level III antiballistic properties. These antiballistic properties ensure that protection is afforded by the radome wall structure against a 7.62 mm, 150 grain (9.6 gram) full metal jacket (FMJ) projectile having V50 of about 2800 fps (about 847.0 m/s) and a kinetic energy of between about $3.37\times10^3$ to about $3.52\times10^3$ Joules.

Some preferred embodiments will include an antiballistic core comprised of a compressed stack of angularly biased unidirectional polyethylene monolayers. The stack of angularly biased unidirectional polyethylene monolayers may be in the form of unidirectional polyethylene tapes, especially tapes formed of ultrahigh molecular weight polyethylene (UHMWPE).

The antireflective (AR) external surface layers according to some embodiments are subwavelength surface (SWS) structures, for example, a SWS structure comprised of a polypropylene film which is micromachined (e.g., via laser) so as to exhibit recessed relief structures that are suitable for X-band frequencies (8-18 GHz).

Other functional layers may be interposed between the antiballistic core and the AR surface layers. For example, at least one face layer comprised of a reinforced resin matrix (e.g., cyanate ester resin, epoxy resin or the like) may be interposed between the core and a respective one (or each) of the AR surface layers. The reinforcement for the resin matrix in such face layer(s) may include glass, graphite, carbon and like structural reinforcement fillers in fiber, mesh, particulate or other forms. Some preferred embodiments will include face layer(s) formed of a glass-reinforced cyanate ester resin matrix.

The radome wall structure may be provided in any shape when formed as a part of a radome to protect radar antenna associated with a radar system. Thus, the wall structure may be flat or curved. Typically, the radome and its associated wall structure will be convexly curved.

These and other aspects of the present invention will become more clear after careful consideration is given to the following detailed description of a presently preferred exemplary embodiment thereof.

FIG. 1 is a cross-sectional perspective view of a radome wall structure according to an embodiment of this invention;

FIGS. 1A and 1B respectively depict in greater detail the antireflective (AR) layer employed in the radome wall structure of FIG. 1;

Figure 6:
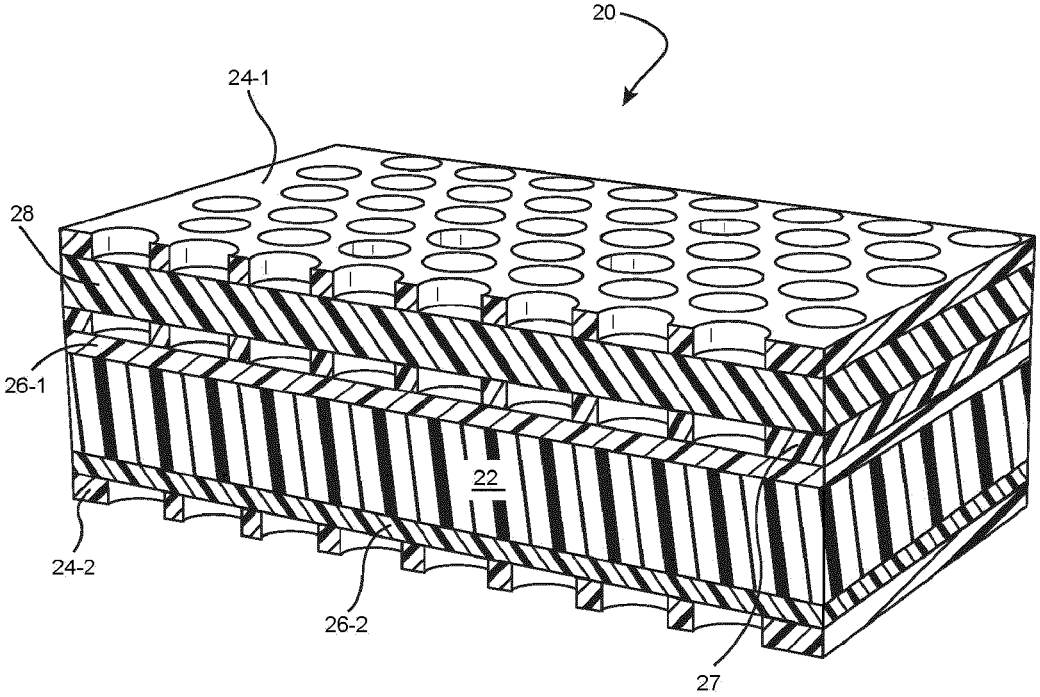
Figure 7:
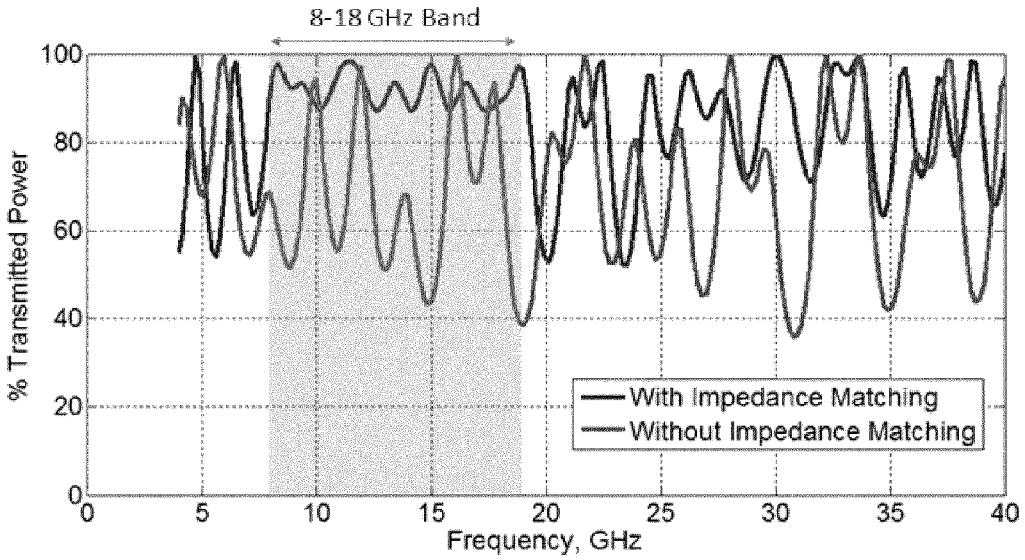
Figure 8:
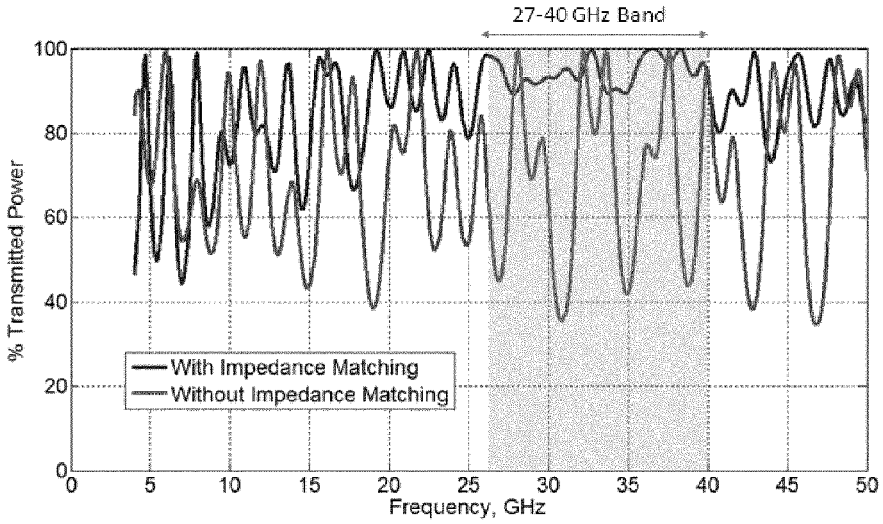

FIG. 6 is a cross-sectional perspective view of a radome wall structure according to another embodiment of this invention; and FIGS. 7 and 8 are plots of transmission loss (dB) versus frequency (GHz) and percent (%) transmitted power versus frequency (GHz), respectively, for a radome wall structure according to an embodiment of this invention and other comparative radome wall structures conducted in accordance with Example 3 below.

The composite radome wall structures as disclosed herein exhibit both antiballistic and radar transparency properties. The radome wall structures may thus be usefully employed to form radomes, e.g., typically dome-shaped structures that protect radar antennas. A radome can be flat, ogival or the like, but typically it is preferred to be dome-shaped. Radomes are found on aircraft, vehicles, sea-faring vessels, and on ground-based installations.

As noted previously, the composite radome wall structures as disclosed herein will generally comprise an antiballistic internal solid, void-free core and external surface layers which sandwich the core. One or more other functional layers may optionally be positioned between the antiballistic core and one (or both) of the external AR surface layers so as to enhance bonding of the core to the AR surface layers and/or selective tune the radome wall structure to the frequency of transmission and reception associated with the radar system.

The antiballistic core is most preferably a solid, void-free polymeric material (e.g., a polyolefin selected from polyethylene and/or polypropylene) that has a plurality of unidirectionally oriented polymer monolayers cross-plied and compressed at an angle relative to one another. According to some preferred embodiments, each of the monolayers is composed of ultrahigh molecular weight polyethylene (UHMWPE) essentially devoid of bonding resins.

The UHMWPE forming the monolayers may be in the form of tapes as disclosed in U.S. Pat. Nos. 7,993,715 and 8,128,778 (incorporated fully hereinto by reference). Preferably, the tapes used to form the core have a width of at least 2 mm, more preferably at least 5 mm, most preferably at least 10 mm. Although only limited by practicalities, the tapes may have a width of at most 400 mm, or sometimes at most 300 mm, or sometime at most 200 mm.

The tapes may have an areal density of between 5 and 200 $g/m^2$, sometimes between 8 and 120 $g/m^2$, or sometimes between 10 and 80 $g/m^2$. The areal density of a tape can be determined by weighing a conveniently cut surface from the tape. The tapes may have an average thickness of at most 120 μm, sometimes at most 50 μm, and sometimes between 5 and 29 μm. The average thickness can be measured e.g. with a microscope on different cross-sections of the tape and averaging the results.

Suitable polyolefins that may be used in manufacturing the tapes are in particular homopolymers and copolymers of ethylene and propylene, which may also contain small quantities of one or more other polymers, in particular other alkene-1-polymers.

Particularly good results are obtained if linear polyethylene (PE) is selected as the polyolefin. Linear polyethylene is herein understood to mean polyethylene with less than 1 side chain per 100 C atoms, and preferably with less than 1 side chain per 300 C atoms; a side chain or branch generally containing at least 10 C atoms. Side chains may suitably be measured by FTIR on a 2 mm thick compression moulded film, as mentioned in e.g. EP 0269151. The linear polyethylene may further contain up to 5 mol % of one or more other alkenes that are copolymerisable therewith, such as propene, butene, pentene, 4-methylpentene, octene. Preferably, the linear polyethylene is of high molar mass with an intrinsic viscosity (IV, as determined on solutions in decalin at 135° C.) of at least 4 dl/g; more preferably of at least 8 dl/g. Such polyethylene is also referred to as ultra-high molar mass polyethylene. Intrinsic viscosity is a measure for molecular weight that can more easily be determined than actual molar mass parameters like Mn and Mw. There are several empirical relations between IV and Mw, but such relation is highly dependent on molecular weight distribution. Based on the equation $Mw=5.37\times10^4$ [IV]1.37 (see EP 0504954 A1) an IV of 4 or 8 dl/g would be equivalent to Mw of about 360 or 930 kg/mol, respectively.

The tapes may be also prepared by feeding a polymeric powder between a combination of endless belts, compression-moulding the polymeric powder at a temperature below the melting point, also referred to as the melting temperature, thereof and rolling the resultant compression-moulded polymer followed by drawing. Such a process is for instance described in EP 0 733 460 A2, which is incorporated herein by reference. Compression moulding may also be carried out by temporarily retaining the polymer powder between the endless belts during conveyance. This may for instance be done by providing pressing platens and/or rollers in connection with the endless belts. Preferably UHMWPE is used in this process and needs to be drawable in the solid state.

Another preferred process for the formation of tapes comprises feeding a polymer to an extruder, extruding a tape at a temperature above the melting point thereof and drawing the extruded polymer tape. Preferably the polyethylene tapes are prepared by a gel process. A suitable gel spinning process is described in for example GB-A-2042414, GB-A-2051667, EP 0205960 A and WO 01/73173 A1, and in "Advanced Fibre Spinning Technology", Ed. T. Nakajima, Woodhead Publ. Ltd (1994), ISBN 185573 182 7. Such processes can be easily modified to produce tapes by using a slit extrusion die. In short, the gel spinning process comprises preparing a solution of a polyolefin of high intrinsic viscosity, extruding the solution into a tape at a temperature above the dissolving temperature, cooling down the tape below a gelling temperature, thereby at least partly gelling the tape, and drawing the tape before, during and/or after at least partial removal of the solvent.

Drawing, preferably uniaxial drawing, of the produced tape may be carried out by means known in the art. Such means comprise extrusion stretching and tensile stretching on suitable drawing units. To attain increased mechanical strength and stiffness, drawing may be carried out in multiple steps. In case of the preferred ultrahigh molecular weight polyethylene tapes, drawing is typically carried out uniaxially in a number of drawing steps. The first drawing step may for instance comprise drawing to a stretch factor of 3. In case that the polyolefin is UHMWPE, a multiple drawing process is preferably used where the tapes are stretched with a factor of 9 for drawing temperatures up to 120° C., a stretch factor of 25 for drawing temperatures up to 140° C., and a stretch factor of 50 for drawing temperatures up to and above 150° C. By multiple drawing at increasing temperatures, stretch factors of about 50 and more may be reached. This results in high strength tapes, whereby for tapes of ultrahigh molecular weight polyethylene, a strength range of 1.2 GPa to 3 GPa may easily be obtained.

The resulting drawn tapes may be used as such or they may be cut to their desired width, or split along the direction of drawing. For UHMWPE tapes, the areal density is preferably less than 50 g/m$^2$ and more preferably less than 29 g/m$^2$ or 25 g/m$^2$. Preferably the tapes have a tensile strength of at least 0.3 GPa, more preferably at least 0.5 GPa, even more preferably at least 1 GPa, most preferably at least 1.5 GPa.

A plurality of polyolefin tapes will form a monolayer and each monolayer may then be stacked at a bias relative to the unidirectional drawing of the tapes with other adjacent monolayers in order to form the core. The tapes may be situated side-by-side in either an overlapping or edge-abutted manner. According to some embodiments, the tapes of each monolayer may be woven as described, for example in WO 2006/075961, the content of which is incorporated herein by reference. In this regard, a woven layer may be made from tape-like warps and wefts comprising the steps of feeding tape-like warps to aid shed formation and fabric take-up; inserting tape-like weft in the shed formed by said warps; depositing the inserted tape-like weft at the fabric-fell; and taking-up the produced woven layer; wherein the step of inserting the tape-like weft involves gripping a weft tape in an essentially flat condition by means of clamping, and pulling it through the shed. The inserted weft tape is preferably cut off from its supply source at a predetermined position before being deposited at the fabric-fell position. When weaving tapes, specially designed weaving elements are used in the weaving process. Particularly suitable weaving elements are described in U.S. Pat. No. 6,450,208, the content of which is also incorporated in the present application by reference. Preferred woven structures are plain weaves, basket weaves, satin weaves and crow-foot weaves. A plain weave is most preferred.

Preferably the weft direction in the layer of a ply is under an angle with the weft direction of the layer in an adjacent ply. The angle is about 90°.

In another embodiment, the layer of tapes contains an array of unidirectionally arranged tapes, i.e., tapes running along a common direction. While the tapes may partially overlap along their length, they may also be edge abutted along their length. If overlapped, the overlapping area may be between about 5 μm to about 40 mm wide. Preferably, the common direction of the tapes in the layer of a ply is under an angle with the common direction of the tapes in the layer of an adjacent ply. The bias angle between adjacent monolayers may be between about 20 to about 160°, sometimes between about 70 to about 120°, and still sometimes at an angle of about 90°.

The tapes may then be compressed under a temperature below the melting point temperature of the polyethylene, preferably 110 to 150° C. and under a pressure of 10 to 100 N/cm$^2$. The resulting monolayer may then be assembled into a stack with other monolayers.

The stack of bias-plied monolayers, preferably devoid of bonding resins or materials may then be compressed under increased pressure and elevated temperature for a time sufficient to form the antiballistic core. According to some embodiments, the core may contain between 70 to 280 polyethylene monolayers compressed at an angle relative to one another.

The stack of monolayers may be compressed at a temperature below the melting point of the UHMWPE. Typically compressing the stack of monolayers may be accomplished at a compression temperature between about 90 to about 150° C., sometimes between about 115° C. to about 130° C., optionally cooling to below 70° C. at a substantially constant pressure. By compression temperature is meant the temperature at half the thickness of the compressed stack of monolayers. Compression pressures of between 100 to 180 bar, sometimes between 12 to 160 bar for a compression time of between about 40 to about 180 minutes may be employed.

The antiballistic core may additionally or alternatively comprise monolayers containing unidirectionally (UD) oriented fibers as disclosed more completely, for example, in U.S. Pat. Nos. 5,766,725 and 7,527,854 and U.S. Patent Application Publication No. 2010/0064404 (the entire contents of each being expressly incorporated hereinto by reference). The fibers in the antiballistic core may have a tensile strength of between 3.5 and 4.5 GPa. The fibers preferably have a tensile strength of between 3.6 and 4.3 GPa, more preferably between 3.7 and 4.1 GPa or most preferably between 3.75 and 4.0 GPa. High performance polyethylene fibers or highly drawn polyethylene fibers consisting of polyethylene filaments that have been prepared by a gel spinning process, such as described, for example, in GB 2042414 A or WO 01/73173 (incorporated by reference herein), are even more preferably used. The advantage of these fibers is that they have very high tensile strength combined with a light weight, so that they are in particular very suitable for use in lightweight ballistic-resistant articles.

The UD fibers forming the monolayers may be bound together by means of a matrix material which may enclose the fibers in their entirety or in part, such that the structure of the mono-layer is retained during handling and making of preformed sheets. The matrix material can be applied in various forms and ways; for example as a film between monolayers of fiber, as a transverse bonding strip between the unidirectionally aligned fibers or as transverse fibres (transverse with respect to the unidirectional fibres), or by impregnating and/or embedding the fibres with a matrix material.

As used herein, the term "antiballistic properties" means that the article achieves a National institute of Justice (NIJ) Standard Level III protection against a 7.62 mm, 150 grain full metal jacket (FMJ) projectile having V50 of 2800 fps and/or the National Institute of Justice (NIJ) level IV standard, which equates to kinetic energy greater than a 30 caliber AP bullet at a nominal of velocity 868 meters per second with a weight of 10.8 grams.

The thickness of the rigid core may vary provided it has antiballistic properties. In general, the thickness of the core may vary from about 10 mm to about 60 mm, sometimes between about 15 mm to about 40 mm. Some embodiments of the core will have a thickness of about 25 mm (+/− about 0.5 mm).

The antiballistic core as described previously is preferably sandwiched between a pair of external antireflective (AR) surface layers. The AR surface layers can be a coating or a film of material to achieve the desired radar transparency. According to some embodiments, the AR surface layers are subwavelength structures (SWS) that are suitable for X-band (8-18 GHz) frequencies.

The term "subwavelength structure" (abbreviated as "SWS") is meant to refer to a layer of material having surface relief gratings with a size smaller than the wavelength of the incident radiation. Antireflective layers may for example be formed according to the techniques described in Mirotznik et al, *Broadband Antireflective Properties of Inverse Motheye Surfaces*, IEEE Transactions on Antennas and Propagation, Vol. 58, No. 9, September 2010 and Mirotznik et al, *Iterative Design of Moth-Eye Antireflective Surfaces at millimeter wave Frequencies*, Microwave and Optical Technology letters, Vol. 52, No. 3, March 2010, the entire content of each being expressly incorporated hereinto by reference.

According to certain embodiments, the external SWS layers of the composite radome wall structure will be formed of micromachined (e.g., via laser) polypropylene film having a thickness between about 2 to about 10 mm, sometimes between about 4 to about 6 mm. A polypropylene film having a thickness of between about 4.5 to about 5 mm can be used according to certain embodiments.

The polypropylene film may be laser-machined so as to achieve a dense plurality of recessed relief structures consisting of an upper generally cylindrical recess and a lower generally cylindrical aperture concentrically positioned with respect to the recess. The average depth and diameter of the upper recess can range from between about 4.0 to about 6.0 mm each. Preferably, for K-band frequencies, the average depth and diameter of the upper recess will typically be about 4.64 mm and 5.16 mm, respectively. The average depth and diameter of the lower aperture will typically be between about 2.5 to about 3.0 mm and between about 4.5 to about 5.0 mm, respectively. For K-band frequencies, the average depth and diameter of the lower aperture will typically be about 4.88 mm and about 2.78 mm, respectively. The recessed relief structures are symmetrically positioned in a dense plurality of offset rows and columns with the centers of adjacent recessed relief structures being separated from one another by between about 5.0 to about 7.0 mm, typically about 6.0 mm.

Moth-eye surfaces can either protrude outwardly or be inwardly inverted recesses. Preferably, for the embodiments disclosed herein the moth-eye surfaces are inwardly inverted recesses. Essentially, a moth-eye surface creates an effective dielectric constant ($\acute{\varepsilon}$) which increases the transmission efficiency of an electromagnetic signal, especially passing from air ($\varepsilon$ air≈1.0) to the outer layer of the radome. This can also be accomplished with stacked layers of film with specifically tuned dielectric properties and thicknesses. This technique can be used with a wide array of materials, however it is presently preferred to use a crosslinked polystyrene microwave plastic (REXOLITE® polystyrene) in conjunction with an inverse moth-eye technique SWS structure. Another material that may be employed satisfactorily is a low loss plastic stock (e.g., ECCOSTOCK® HiK material) having a dielectric constant ranging from 3.0 to 15. The moth-eye surface may be fabricated via a CNC machine to the specifications which are determined by the desired frequency response of the structure according to techniques well known to those in this art.

Additional layers may be employed between the antiballistic core and the external AR surface layers so as to enhance bonding of the core to the AR surface layers and/or to impedance match the radome wall structure with a desired radar frequency range.

The adhesion between the antiballistic core and the face sheet is preferably accomplished by the use of a thermoplastic adhesive. Particularly preferred are ionomer grades of thermoplastic resins, such as an ethylene/methacrylic acid (E/MAA) copolymer in which the MAA acid groups have been partially neutralized with sodium ions. One presently preferred resin for such purpose is SURLYN® 8150 sodium ionomer thermoplastic resin.

Surface bonding of the antiballistic core and the face sheet may also be achieved by plasma and/or corona treatment techniques.

One such additional layer that may be employed is a face sheet formed of a reinforced resin matrix layer that is interposed between the AR layer and the antiballistic core. Resin matrices such as cyanate ester resins and/or epoxy resins may be employed for such purpose. Cyanate ester resins are known in the art as having desirable electrical and thermal properties. Cyanate ester resins are described for example in U.S. Pat. No. 3,553,244 included herein by reference. The curing of these resins is affected by heating, particularly in the presence of catalysts such as those described in U.S. Pat. Nos. 4,330,658; 4,330,669; 4,785,075 and 4,528,366. By a cyanate ester resin is also understood herein a blend of cyanate ester resins as for example those disclosed in U.S. Pat. Nos. 4,110,364; 4,157,360, 4,983,683; 4,902,752 and 4,371,689.

Preferably the cyanate ester resin is a flame retardant cyanate ester resin such as one disclosed in Japanese Patent No. 05339342 and U.S. Pat. No. 4,496,695, which describe blends of cyanate esters and brominated epoxies, or poly (phenylene ether) (PPE), cyanate esters and brominated epoxies. More preferably, the cyanate ester resin is a flame retardant blend of brominated cyanate esters as disclosed in U.S. Pat. Nos. 4,097,455 and 4,782,178 or a blend of cyanate esters with the bis(4-vinylbenzylether)s or brominated bisphenols as described in U.S. Pat. Nos. 4,782,116, and 4,665,154. Blends of cyanate esters with brominated poly (phenylene ether)s, polycarbonates or pentabromobenzylacrylates as disclosed in Japanese Patent No. 08253582 are also suitable for utilization in the present invention.

Suitable epoxy resins to be used in forming the resin matrix of the face layer may for example be those comprising epoxy monomer or resin in amounts of from about 20% by weight to about 95% by weight, based on the total weight of the coating formulation. Some embodiments will include from about 30% by weight to about 70% by weight epoxy monomer in a curable coating formulation. Epoxy resins may be used including the EPON Resins from Shell Chemical Company, Houston, Tex., for example, EPON Resins 1001F, 1002F, 1007F and 1009F, as well as the 2000 series powdered EPON Resins, for example, EPON Resins 2002, 2003, 2004 and 2005. The epoxy monomer or resin may have a high crosslink density, a functionality of about 3 or greater, and an epoxy equivalent weight of less than 250. Exemplary epoxies which may be employed according to embodiments of the invention include The Dow Chemical Company (Midland, Mich.) epoxy novolac resins D.E.N. 431, D.E.N. 438 and D.E.N. 439.

A curing agent for the epoxy resin may also be added in amounts of from about 1% by weight to about 10% by weight of the epoxy component. The curing agent may be a catalyst or a reactant, for example, the reactant dicyandiamide. From about 1% by weight to about 50% by weight epoxy solvent, based on the weight of the coating formulation, may also be included in the coating formulations. Epoxy solvents can be added to liquefy the epoxy monomer or resin or adjust the viscosity thereof, or which triethylphosphate and ethylene glycol are preferred. A separate epoxy solvent may not be needed according to some embodiments of the invention wherein the epoxy is liquid at room temperature or wherein a fluorinated monomer or surfactant component of the coating formulation acts as a solvent for the epoxy.

The face sheets according to certain embodiments of the invention will preferably exhibit a dielectric constant (ε) of at most 6.0, sometimes at most 5.0, and still sometimes at most 4.0. According to some embodiments, the face sheets will exhibit a dielectric constant Preferably said dielectric constant (ε) of the face sheets will be between about 2.0 to about 4.0, sometimes between 3.0 and 3.75. A face sheet formed of a glass-reinforced cyanate ester resin having a dielectric constant (ε) of between about 3.5 to about 3.7 may advantageously be employed.

The dielectric constant and dielectric loss of the epoxy resin can be routinely measured with an electromagnetic transmission line positioned into an electromagnetic noise free room using a coaxial probe. Preferably the dielectric loss of the reinforced face sheets is at most 0.025, more preferably at most 0.0001. Preferably, said dielectric constant is between 0.0001 and 0.0005.

The face sheets may be in the form of a single or multiple ply film, a scrim, fibers, dots, patches, and the like. Preferably, the face sheet layers are in the form of a scrim, more preferably of a film. Usually the face sheet layers are applied directly onto a respective face surface of the antiballistic core as a non- or partially-cured resin composition which is cured subsequently during a process of consolidating the plurality of plies contained by the material of the invention. The face sheets may be interposed between each of the external AR surface layers and the antiballistic core or may optionally only be interposed between one core surface and a corresponding adjacent AR surface layer.

The resin matrix forming the face sheets is most preferably reinforced with a suitable fibrous or particulate filler material. Thus, the resin matrix of the face sheet may include fibrous or particulate glass, graphite and/or carbon materials. Preferred is glass fibers, e.g., S-glass or E-glass fibers.

Methods of Manufacture

The external AR surface layers and optional impedance matching layers may be assembled onto the antiballistic core by any conventional means. The various layers of the thus assembled radome wall preform may then be consolidated by subjecting them to pressure, preferably at a temperature below the melting temperature (Tm) of the polyolefin as determined by DSC. Useful pressures include pressures of at least 50 bar, sometimes at least 75 bar, and other times at least 100 bar. The temperature of consolidation may be between 10° C. below Tm and Tm, sometimes between 5° C. below Tm and 2° C. below Tm. The temperature used should be above the curing temperature of the cyanate ester resin. Suitable temperatures when UHMWPE tapes are used, are between 120° C. and 150° C., more preferably between 130° C. and 140° C.

The adhesion of the face sheets to the antiballistic core may be enhanced by via subjecting the surfaces of the core onto which the face sheets are applied to a corona treatment and/or plasma treatment.

EXAMPLES

Example 1

Figure 1:
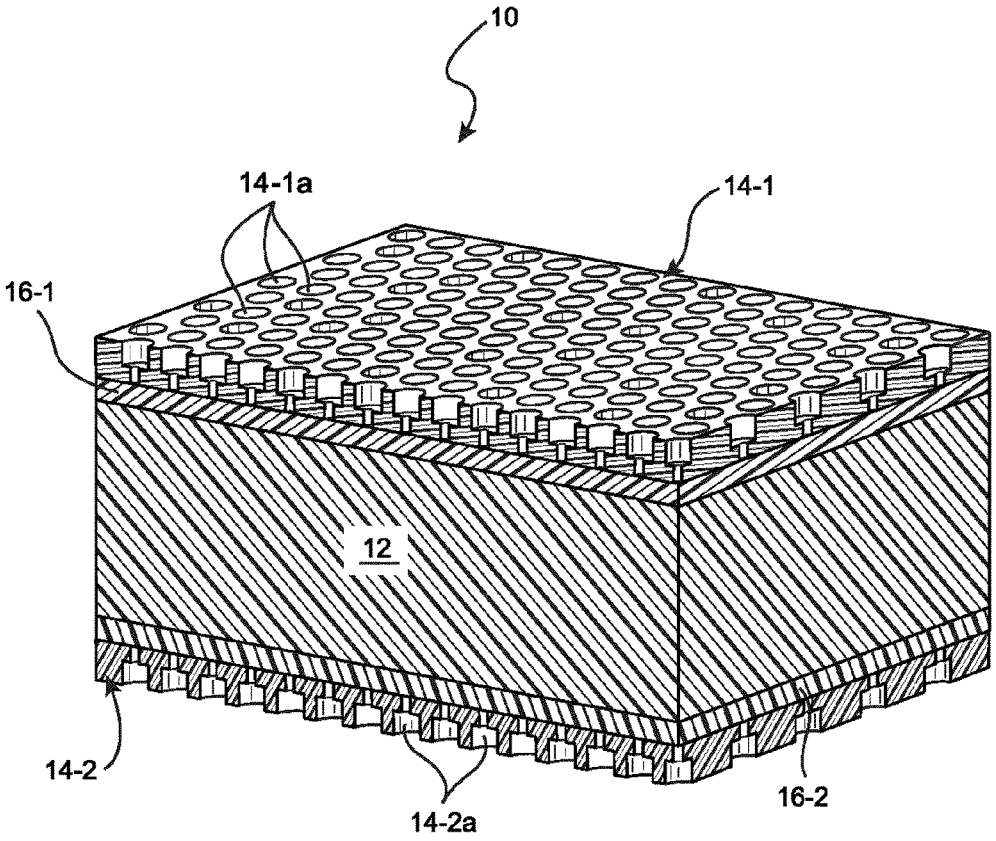

Accompanying FIG. 1 is a schematic cross-sectional perspective view of a radome wall structure 10 in accordance with an embodiment of the invention. The radome wall structure 10 as shown in FIG. 1 includes an antiballistic core 12 formed of consolidated UHMWPE monolayers as described previously sandwiched between external AR surface layers 14-1, 14-2, respectively. The AR surface layers 14-1, 14-2 in the embodiment shown are formed of SWS structured cross-linked polystyrene microwave plastic (REXOLITE® 1422 polystyrene). The AR surface layers 14-1, 14-2 are moth-eye surfaces, that is each surface layer 14-1, 14-2 includes micromachined subwavelength surface (SWS) structures in the form of recesses, a representative few of which are identified by reference numerals 14-1*a*, 14-2*a*, respectively.

Respective single ply face sheets of S-glass reinforced cyanate ester material 16-1, 16-2 are interposed between the antiballistic core 12 and each of the AR surface layers 14-1, 14-2, respectively.

The antiballistic core 12 had a thickness of about 25.4 mm, while the AR surface layers 14-1, 14-2 were each about 9.525 mm thick. The single ply face sheets 16-1, 16-2 were about 11 mils (about 0.279 mm) thick.

Figure 1A:
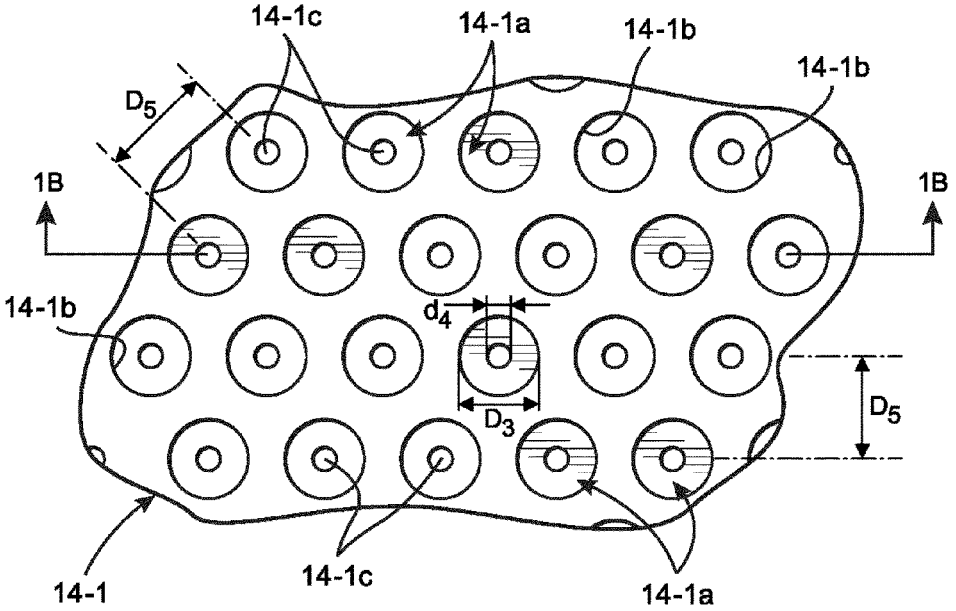
Figure 2:
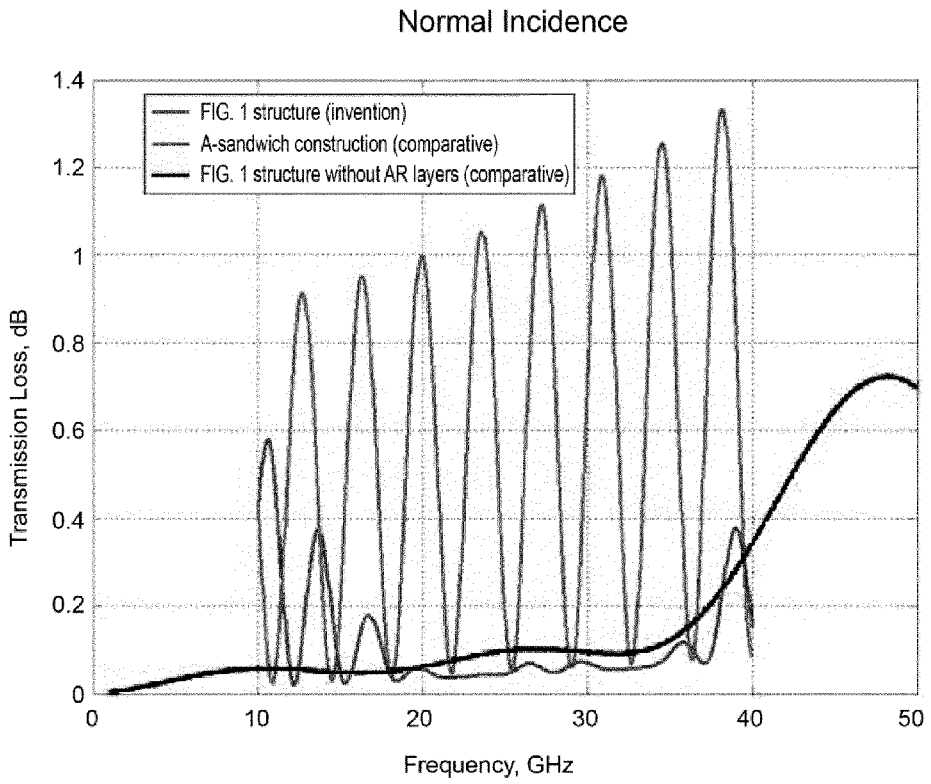
FIG. 2 is a plot of transmission loss (dB) versus frequency (GHz) for a radome wall structure according to an embodiment of this invention and other comparative radome wall structures conducted in accordance with Example 1 below.

The AR surface layers 14-1, 14-2 were structured as shown in FIGS. 2A and 2B. In this regard, AR surface layer 14-1 is depicted by way of example in FIGS. 2A and 2B, it being understood that the AR surface layer 14-2 was similarly configured. Specifically, each of the SWS structures 14-1*a* were in the form of recesses which included an upper generally cylindrical recess 14-1*b* and a generally cylindrical aperture 14-1*c*. The diameter and depth dimensions $D_1$ and $d_2$, respectively, of the upper generally cylindrical recess 14-1*b* were about 5.195 mm and about 4.640 mm, respectively. The diameter and depth dimensions $D_3$ and $d_4$ of the lower aperture 14-1*c* were about 2.778 mm and about 4.885 mm, respectively. Adjacent ones of the SWS structures 14-1*a* were separated by a distance $D_5$ by about 6.00 mm. As shown in FIG. 1A, the SWS structures 14-1*a* were aligned in rows with each of the structures 14-1*a* being offset by one-half the separation distance $D_5$ with respect to the structures 14-1*a* in an adjacent row.

Figure 1B:
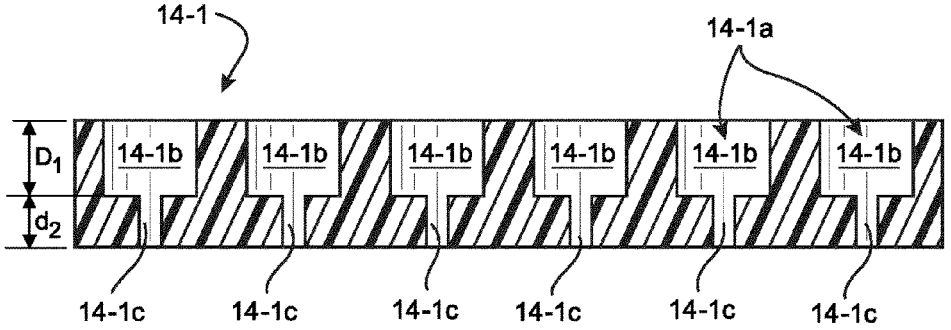

The composite radome wall structure of FIG. 1 having the AR surface layers 14-1, 14-2 as shown in FIGS. 1A and 1B, was subjected to normal incidence radiation in an anechoic chamber between the frequencies of about 10 GHz to about 40 GHz. The radiation transmission loss (dB) was plotted against the frequency and compared with a conventional A-sandwich construction radome wall structure containing a honeycomb core. In addition, the structure of FIG. 1 was also tested in the absence of the external AR surface layers. The results appear in FIG. 2.

As can be seen, the embodiment of the invention attained less than 0.5 dB transmission loss throughout the frequencies of interest, namely 26 to 40 GHz. Moreover, the radiation transmission loss characteristics of the embodiment according to the invention were comparable to the conventional A-sandwich radome wall construction of the prior art having a honeycomb core over the 26 to 40 GHz frequency range of interest.

Figure 3A:
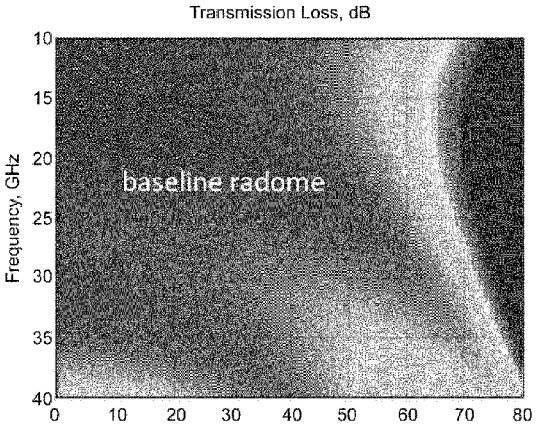
FIGS. 3A and 3B are transmission loss (dB) plots of frequency (GHz) versus incident angle (degrees) of a conventional non-antiballistic radome honeycomb composite wall structure and an antiballistic radome wall structure of an embodiment according to this invention as depicted in FIG. 2.
Figure 3B:
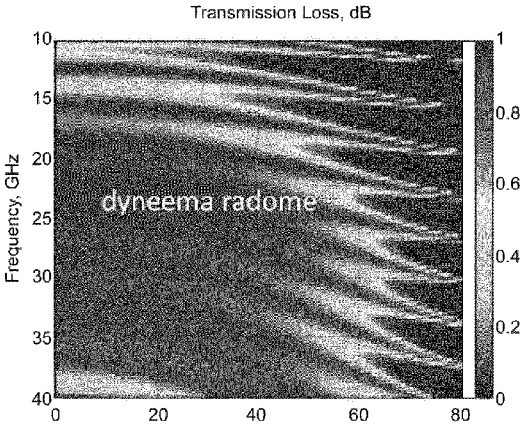

FIGS. 3A and 3B show the transmission loss (dB) of a radome wall structure in accordance with FIG. 1 at varying radiation incident angles in comparison to a conventional A-sandwich radome wall construction of the prior art having a honeycomb core. As can be seen, both radome wall structures show that over the 26 to 40 GHz frequency range of interest, the transmission losses are somewhat comparable.

Example 2

Example 1 was repeated by subjecting a composite radome wall structure of FIG. 1 having the AR surface layers 14-1, 14-2 as shown in FIGS. 1A and 1B, to normal incidence radiation in an anechoic chamber between the frequencies of about 4 GHz to about 40 GHz. The results are shown in accompanying FIGS. 4 and 5.

Figure 4:
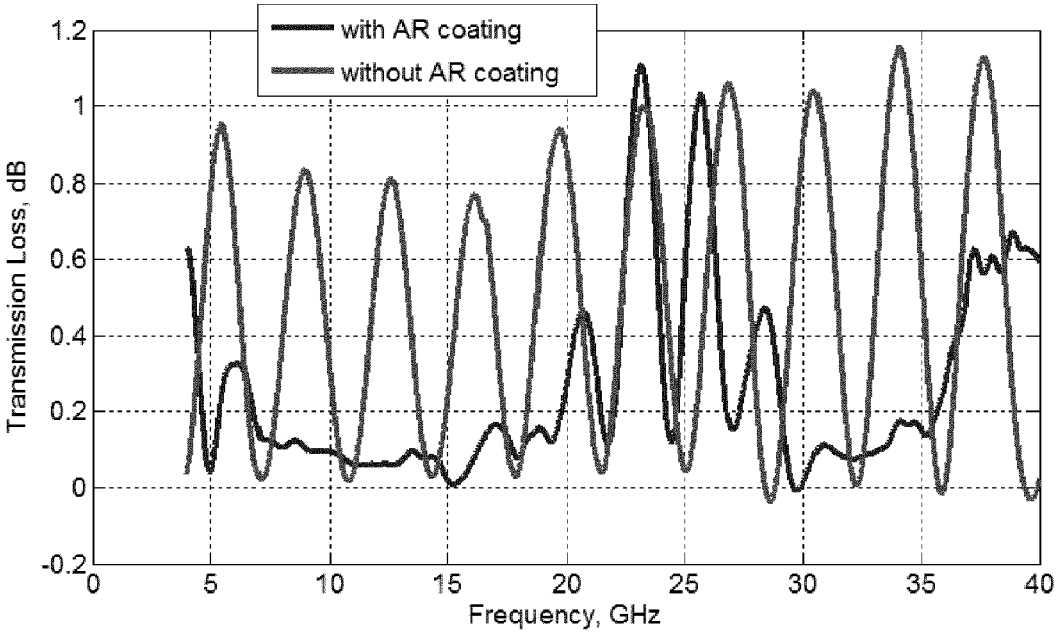
FIGS. 4 and 5 are plots of transmission loss (dB) versus frequency (GHz) and percent (%) transmitted power versus frequency (GHz), respectively, for a radome wall structure according to an embodiment of this invention and other comparative radome wall structures conducted in accordance with Example 2 below.
Figure 5:
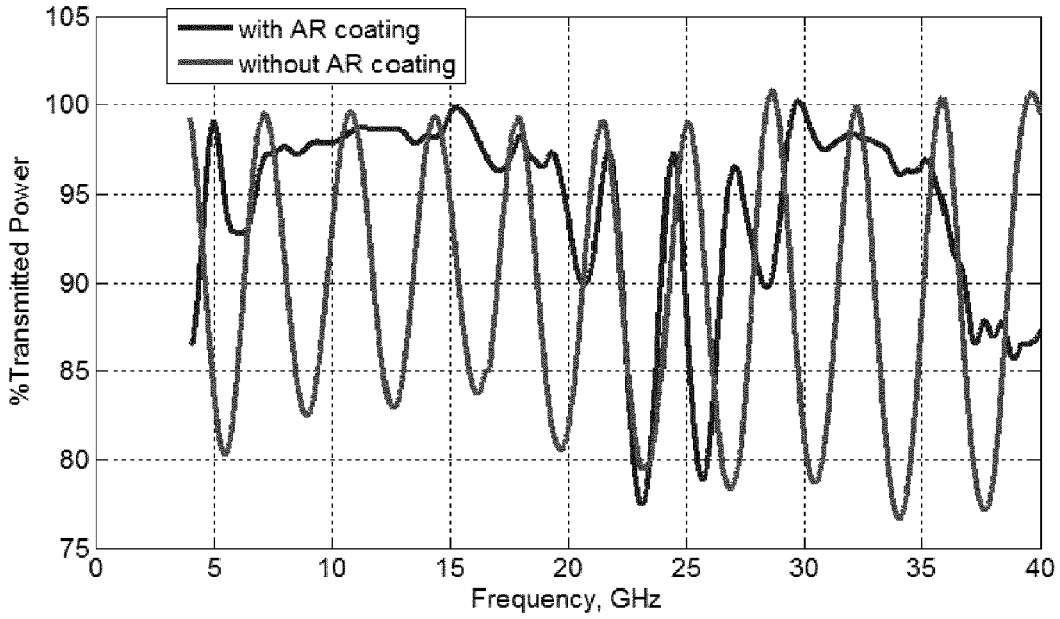

As can be seen in FIGS. 4 and 5, over the X-band frequencies of 8 to 18 GHz, the composite radome wall structure exhibited a transmission loss of less than 0.2 dB and a percent transmitted power of greater than 95%.

Example 3

FIG. 4 is cross-sectional elevational view of another embodiment of a radome wall structure 20 in accordance with the invention. As with the structure of FIG. 1, the radome wall structure 20 of FIG. 4 includes a solid void-free antiballistic core 22 and external AR surface layers 24-1, 24-2. Respective single ply face sheets of S2-glass reinforced cyanate ester material 26-1, 26-2 are positioned adjacent each opposed face of the antiballistic core 22 so that one of the sheets 26-2 is sandwiched between the core 22 and the AR surface layer 24-2. Additional impedance matching layers 27 and 28 are interposed between the cyanate ester sheet 26-1 and the AR surface layer 24-1. Layer 27 is a controlled dielectric constant (ε) material known as ECCOSTOCK® HiK material which can exhibit a dielectric constant ranging from 3 to 15. Impedance matching layer 28 is an alumina oxide ($Al_2O_3$) ceramic with a dielectric constant of 9. One additional functional purpose of the ceramic layer 28 is serve as antiballistic protection since it acts as a strike face of the radome structure 20 to prevent high level threats such as armor piercing (AP) bullets from penetration. These antiballistic threat levels generally exceed the National Institute of Justice (NIJ) level IV standard, which equates to kinetic energy greater than a 30 caliber AP bullet at a nominal of velocity 868 meters per second with a weight of 10.8 grams.

Structures of FIG. 4 were examined to determine the percent of transmitted power with and without the impedance matching layers provided by the external AR surface layers 26-1, 26-2 at both the X-band frequencies of 8.0 to 18.0 GHZ and the $K_A$-band frequencies of 27.0-40.0 GHz and. The results are shown in graphs FIGS. 7 and 8, respectively. As can be seen, with the impedance matching provided by the AR surface layers 26-1 and 26-2, greater than 90% of the transmitted power was achieved within the X-band (FIG. 7) and $K_A$-band (FIG. 8) frequency ranges.

Example 4

Example 1 was repeated by interposing one layer of a structural foam polyurethane foam commercially purchased from HEXCEL with a thickness of 0.76 mm between the each single ply face sheets of S-glass reinforced cyanate ester material 16-1, 16-2 respectively and the antiballistic core 12. The so-formed composite radome wall was subjected to normal incidence radiation in an anechoic chamber between the frequencies of about 4 GHz to about 40 GHz.

The antiballistic core 12 had a thickness of about 25.4 mm, while the AR surface layers 14-1, 14-2 were each about 6.35 mm thick. The single ply face sheets 16-1, 16-2 were about 0.75 mm each.

Over the X-band frequencies of 4 to 40 GHz, the composite radome wall structure exhibited a transmission loss of less than 0.5 dB of transmission loss from 2 to 41 GHz at normal incidence, in addition to good structural and ballistic properties and a percent transmitted power of greater than 90%.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope thereof.

The invention claimed is:

1. A composite radome wall structure comprising:

an antiballistic solid, void-free internal core, antireflective (AR) external surface layers which sandwich the core, and at least one impedance matching layer formed of a ceramic material which is positioned relative to the core to provide a strike face for the composite radome wall structure, wherein the AR external surface layers are subwavelength surface (SWS) structures which include surface relief gratings comprising moth-eye surfaces comprised of inwardly inverted recesses having a size smaller than a wavelength of incident X-band or K-band radiation frequencies.

2. The composite radome wall structure according to claim 1, which exhibits an electromagnetic transmission efficiency at a frequency of 2 to 40 GHz of 90% or greater.

3. The composite radome wall structure according to claim 2, which exhibits National Institute of Justice (NIJ) Standard Level III antiballistic properties.

4. The composite radome wall structure according to claim 1, wherein the antiballistic core comprises a compressed stack of angularly biased unidirectional polyethylene monolayers.

5. The composite radome wall structure according to claim 4, wherein the stack of angularly biased unidirectional polyethylene monolayers comprises unidirectional polyethylene tapes or fibers.

6. The composite radome wall structure according to claim 5, wherein the polyethylene tapes consist of ultrahigh molecular weight polyethylene (UHMWPE).

7. The composite radome wall structure according to claim 1, wherein the SWS structures comprise a cross-linked polystyrene film.

8. The composite radome wall structure according to claim 7, wherein the cross-linked polystyrene film has a thickness between about 2 to about 10 mm.

9. The composite radome wall structure according to claim 8, wherein the cross-linked polystyrene film is micromachined so as to exhibit recessed relief structures.

10. The composite radome wall structure according to claim 9, wherein centers of adjacent ones of the recessed relief structures are separated from one another by about 6.0 mm.

11. The composite radome wall structure according to claim 1, further comprising at least one face sheet layer comprised of a reinforced resin matrix interposed between the core and a respective one of the AR surface layers.

12. The composite radome wall structure according to claim 11, which comprises a reinforced resin matrix layer interposed between the core and each one of the AR surface layers.

13. The composite radome wall structure according to claim 12, wherein the resin matrix face layers include a fibrous or particulate reinforcement filler material.

14. The composite radome wall structure according to claim 13, wherein the reinforcing material is at least one selected from glass, graphite and carbon.

15. The composite radome wall structure according to claim 1, wherein the strike face is positioned between an outer one of the AR external surface layers and the core.

16. The composite radome wall structure according to claim 1, wherein the AR external surface layers comprise a film having a thickness between about 2 to about 10 mm which includes the surface relief gratings.

17. The composite radome wall structure according to claim 1, wherein the surface relief gratings comprise a dense plurality of recessed relief structures, each consisting of an upper generally cylindrical recess and a lower generally cylindrical aperture concentrically positioned with respect to the recesses.

18. The composite radome wall structure according to claim 17, wherein each of the average depth and diameter of the upper recess of the recessed relief structures is between about 4.0 to about 6.0 mm.

19. The composite radome wall structure according to claim 17, wherein the average depth and diameter of the lower aperture of the recessed relief structures is between about 2.5 to about 3.0 mm and between about 4.5 to about 5.0 mm, respectively.

20. The composite radome wall structure according to claim 17, wherein each of the average depth and diameter of the upper recess of the recessed relief structures is between about 4.64 mm to about 5.16 mm, and wherein the average depth and diameter of the lower aperture of the recessed relief structures is about 4.88 mm and about 2.78 mm, respectively.

21. The composite radome wall structure according to claim 17, wherein the recessed relief structures are symmetrically positioned in a dense plurality of offset rows and columns.

22. The composite radome wall structure according to claim 17, wherein centers of adjacent recessed relief structures are separated from one another by between about 5.0 to about 7.0 mm.

23. A radome which comprises the composite radome wall structure of claim 1.

24. A radar system which comprises the radome of claim 23.

25. A method of making a composite radome wall structure comprising:

(i) sandwiching an antiballistic solid, void-free internal core between antireflective (AR) external surface layers which are subwavelength surface (SWS) structures which include surface relief gratings comprising moth-eye surfaces comprised of inwardly inverted recesses having a size smaller than a wavelength of incident X-band or K-band radiation frequencies, and (ii) positioning at least one impedance matching layer that is formed of a ceramic material relative to the core to provide a strike face for the composite radome wall structure.

26. The method according to claim 25, which comprises consolidating the core and AR surface layers under elevated temperature and pressure for a sufficient time to obtain the composite radome wall structure.

27. The method according to claim 26, wherein the step of consolidating the core and AR surface layers is practiced at a temperature of between 120° C. and 150° C. and a pressure of at least 50 bar.

28. The method according to claim 25, wherein the surface relief gratings comprise a dense plurality of recessed relief structures, each consisting of an upper generally cylindrical recess and a lower generally cylindrical aperture concentrically positioned with respect to the recesses.

29. The method according to claim 28, wherein each of the average depth and diameter of the upper recess of the recessed relief structures is between about 4.0 to about 6.0 mm.

30. The method according to claim 28, wherein the average depth and diameter of the lower aperture of the recessed relief structures is between about 2.5 to about 3.0 mm and between about 4.5 to about 5.0 mm, respectively.

31. The method according to claim 28, wherein each of the average depth and diameter of the upper recess of the recessed relief structures is between about 4.64 mm to about 5.16 mm, and wherein the average depth and diameter of the lower aperture of the recessed relief structures is about 4.88 mm and about 2.78 mm, respectively.

32. The method according to claim 28, wherein the recessed relief structures are symmetrically positioned in a dense plurality of offset rows and columns.

33. The method according to claim 28, wherein centers of adjacent recessed relief structures are separated from one another by between about 5.0 to about 7.0 mm.

* * * * *